United States Patent [19]

Roos et al.

[11] 4,308,667

[45] Jan. 5, 1982

[54] CONTINUOUSLY OPERATING MULTISTAGE DRYING INSTALLATION AND A PROCESS FOR CONTINUOUSLY DRYING A WORKPIECE

[75] Inventors: Friedrich Roos, Hauneck; Johannes Bolz, Bad Hersfeld; Ingo Grebe, Neuenstein, all of Fed. Rep. of Germany

[73] Assignee: Babcock-BSH Aktiengesellschaft, Krefeld, Fed. Rep. of Germany

[21] Appl. No.: 126,854

[22] Filed: Feb. 28, 1980

Related U.S. Application Data

[63] Continuation of Ser. No. 894,333, Apr. 7, 1978, abandoned.

[30] Foreign Application Priority Data

Apr. 12, 1977 [DE] Fed. Rep. of Germany ..... 2716086

[51] Int. Cl.[3] ..... F26B 3/04

[52] U.S. Cl. ..... 34/23; 34/31; 34/46; 34/48; 34/155; 34/203; 34/216; 34/217

[58] Field of Search ..... 68/5 C, 5 D, 5 E; 34/155, 23, 31, 66, 211, 213, 216, 217, 203, 46, 48

[56] References Cited

U.S. PATENT DOCUMENTS

| | | | |
|---|---|---|---|
| 1,086,194 | 2/1914 | Marquis | 34/203 |
| 1,310,858 | 7/1919 | Dozier | 34/203 |
| 1,694,489 | 12/1928 | Rubinstein | 34/66 |
| 2,758,386 | 8/1956 | Cobb | 34/66 |
| 2,838,420 | 6/1958 | Valente | 34/217 |
| 3,499,229 | 3/1970 | Roberts | 34/23 |
| 3,545,094 | 12/1970 | Schuette et al. | 34/23 |
| 4,195,418 | 4/1980 | Sturgeon | 34/155 |

*Primary Examiner*—Larry I. Schwartz
*Attorney, Agent, or Firm*—Michael J. Striker

[57] ABSTRACT

A continuously operating multistage drying installation is provided for drying a workpiece. The drying installation includes a conveyor belt for transporting along a predetermined path a workpiece having two opposite longitudinally extending surfaces and containing excess moisture. A first stage drier is located at an upstream portion of the path. This drier includes guide rollers for turning the workpiece over at least once so as to expose both of its surfaces to heat within the drier to thereby preliminarily dry the workpiece. A second stage drier is provided at the path downstream of the first stage drier for finishing the drying of the workpiece to a desired moisture level while maintaining the workpiece free from being turned over to thereby avoid cracking the surfaces of the workpiece due to pressure applied to the demoisturized and consequently relatively brittle surfaces thereof. A process is also provided for continuously drying the workpiece while avoiding pressure on the surfaces of the workpiece during the final drying stage.

5 Claims, 3 Drawing Figures

CONTINUOUSLY OPERATING MULTISTAGE DRYING INSTALLATION AND A PROCESS FOR CONTINUOUSLY DRYING A WORKPIECE

This is a continuation of application Ser. No. 894,333, filed Apr. 7, 1978 now abandoned.

BACKGROUND OF THE INVENTION

The invention relates to a continuously operating drier for webs or sheets of a workpiece in. The inventive drier provides different stages of treatment. The workpiece follows a course between endless belts which pass over guide rollers.

A continuously operating drier of the above-mentioned category has been proposed. The drier is particularly intended for veneer—like plywood—and has a three-belt drying chamber and a thereto connected cooler downstream thereof. The conveyor belts lie under pressure against the veneer and cover the veneer in such a way that the drying heat is essentially transmitted by way of the conveyor belts. Moreover, a glazed or smoothed appearance is bestowed on the veneer by means of the conveyor belt.

Veneer is in the form of a thin layer of generally uniform thickness and is generally cut from timber of fine appearance. The veneer is then glued to the surface of a less expensive material. Since the drying of the veneer takes place exclusively in the three-belt drier according to the above proposal, breakage and cracking of the surface of the veneer can occur as the belts turn the veneer over around guide rollers to thereby expose both longitudinally and sides of the veneer to heat in the drier. The result is diminished value—especially when the veneer is ornamental or is finely grained wood. Another disadvantage of this conventional proposal is that separate regulation of the climate and temperature is not possible for the different stages of the drying progress.

This risk of breakage or cracking can be overcome by using a single-belt drier. However, this advantage is accompanied by the disadvantages of a correspondingly longer length of the drier.

Another proposed continuous drier involves an assembly having a sequence of drying stages adjusted in accordance with a desirable heating or drying capacity. These stages are each provided with separate temperature controls. The drier is provided with equidistantly spaced suction means arranged above and/or below the pathway for the workpiece. However, the veneer workpiece is not satisfactorily dried because the suction means block the heat from portions of the workpiece. Consequently, the desired glazed or smoothed effect does not occur.

SUMMARY OF THE INVENTION

An object of the present invention is to provide a drier which makes possible a protective treatment of a material in a drying installation occupying a minimal horizontal extent.

In accordance with the concept of the invention, a multibelt drier is arranged at the inlet side of the installation. A single-belt drier with a connected cooler is arranged downstream of the multibelt drier. The driers are respectively provided with separate air blowers and heating devices.

Advantageously, the lengths of the three-belt drier and the single-belt drier are the same. The passages between the driers and between the single-belt drier and the cooler are planar. By regulation of the drying temperature and climate, a remote control can be arranged for the veneer in each the different treatment stages. An automatic monitoring system for monitoring the drying temperature with a visual reading instrument to detect deviation from the desired values are advantageously installed in the single-belt drier. Also, an automatic speed regulator for controlling the speed by the belt is desirably connected to the monitoring system.

The inventive concept of combining a multibelt drier with a single belt drier as integral parts of a drying installation attains not only a favorable drying efficiency but also guarantees that no bending of the veneer occurs during the final stage of drying when the veneer is most susceptible to cracking—since the final drying occurs without inverting or turning the veneer. Consequently, damage to the veneer surface due to cracks or tears is avoided. The optimal climate and drying conditions for the veneer can be separately adjusted for each stage through the continuous regulation of climate and temperature. These factors can then be adapted to the progression of drying.

Another object of the invention is to provide a method for continuously drying the workpiece while avoiding pressure on the workpiece surfaces during the final drying stage.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF PREFERRED EMBODIMENTS

The inventive drying installation includes a first drying stage in which a veneer passes through a multi-belt drier, a second drying stage in which the veneer passes through a single-belt drier, and a cooling stage.

Figure 1:
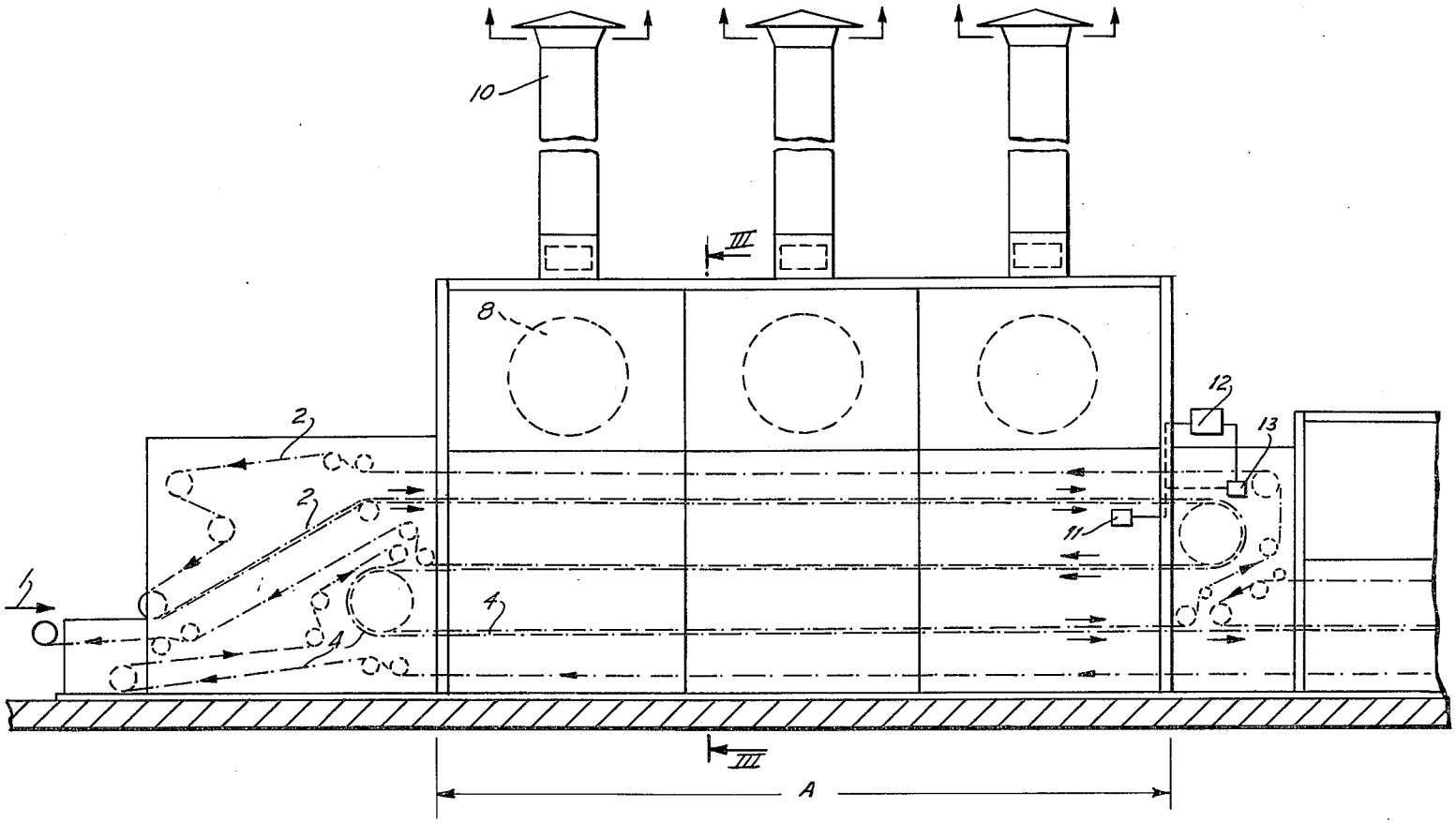
FIG. 1 shows a schematic longitudinal section through a first stage of a continuously operating drier, having multiple conveyor bands or belts.

The veneer is initially carried by endless belts 2, 3, 4 through the three-belt drier A. Conveyor belts 4, 5, 6 and 7 operate to transport the veneer 1 sequentially through the three-belt drier A, the single-belt drier B and the cooler C. Conveyor belt 4 extends continuously from the inside of the three-belt drier A, through the single-belt drier B and through the cooler C. Belt 5 is in the drier B and belts 6 and 7 are in the cooler C. FIG. 1 shows conveyor belt 4 running horizontally as a support band for the veneer 1 through the three-belt drier A as well as through the single-belt drier B. The turning of conveyor belts 2, 3, 4, 5, 6, 7 occurs by means of suitably arranged guide rollers.

The passage between the three-belt drier A and the single-belt drier B and the passage between the single-belt drier B and the cooler C lie in a plane which is preferably horizontal. After leaving the three-belt drier A (in which the veneer is turned), the veneer 1 is no longer being turned—instead the veneer 1 is transported only horizontally. This is the purpose of the planar passages. The length of drier A is preferably at least approximately equivalent to the length of drier B so that the length of the drying path inside drier A is about three times greater than that of drier B, since drier A has three belts each approximately equal to the belt in drier B. However, these lengths and ratios may be changed. Heated air is blown on the veneer 1 by means of blower 8 and past heat exchanger 9.

In the operation of the illustrated embodiment, the veneer 1, which may be plywood, is fed onto conveyor belt 3 at the location of the arrow 1. The veneer is then carried to conveyor belt 4 and to an upper portion of the three-belt drier A. While the three-belt drier may in practice have only one continuous belt, the continuous belt is guided about guide rollers in such a manner that three spaced, generally horizontal pathways are present within the three-belt drier. Of course, it is not necessary to the inventive concept that the drier have three belts or three such horizontal pathways. The number could be for example two, four of five. The number three happens to be a generally convenient number of belts because when a three-belt drier is used, the lengths of the three-belt drier and the single-belt drier can be about the same while together they optimally dry the veneer workpiece. These belts of the three stage drier need not even be arranged to form generally horizontal pathways. Such a generally horizontal orientation is merely convenient.

The veneer workpiece then is transported towards the right on the top conveyor belt 4. The veneer workpiece is turned over to its other side as it and the conveyor belt 4 turns around the guide rollers at the ends of the horizontal pathways. Conveyor belt 2 acts as a cover and prevents the veneer workpiece from falling off the conveyor belt 4. As illustrated in FIG. 1, the workpiece will be intermediate conveyor belts 2 and 4. These conveyor belts 2, 4 run in the same direction with the workpiece sandwiched inbetween and turn around the guide rollers located at the ends of the pathways. The veneer workpiece is then kept from falling off the conveyor pathway. Where the covering belt 2 must diverge from the conveyor belt 4, another covering belt is provided to cover the veneer workpiece as the original covering belt is recycled.

Figure 2:
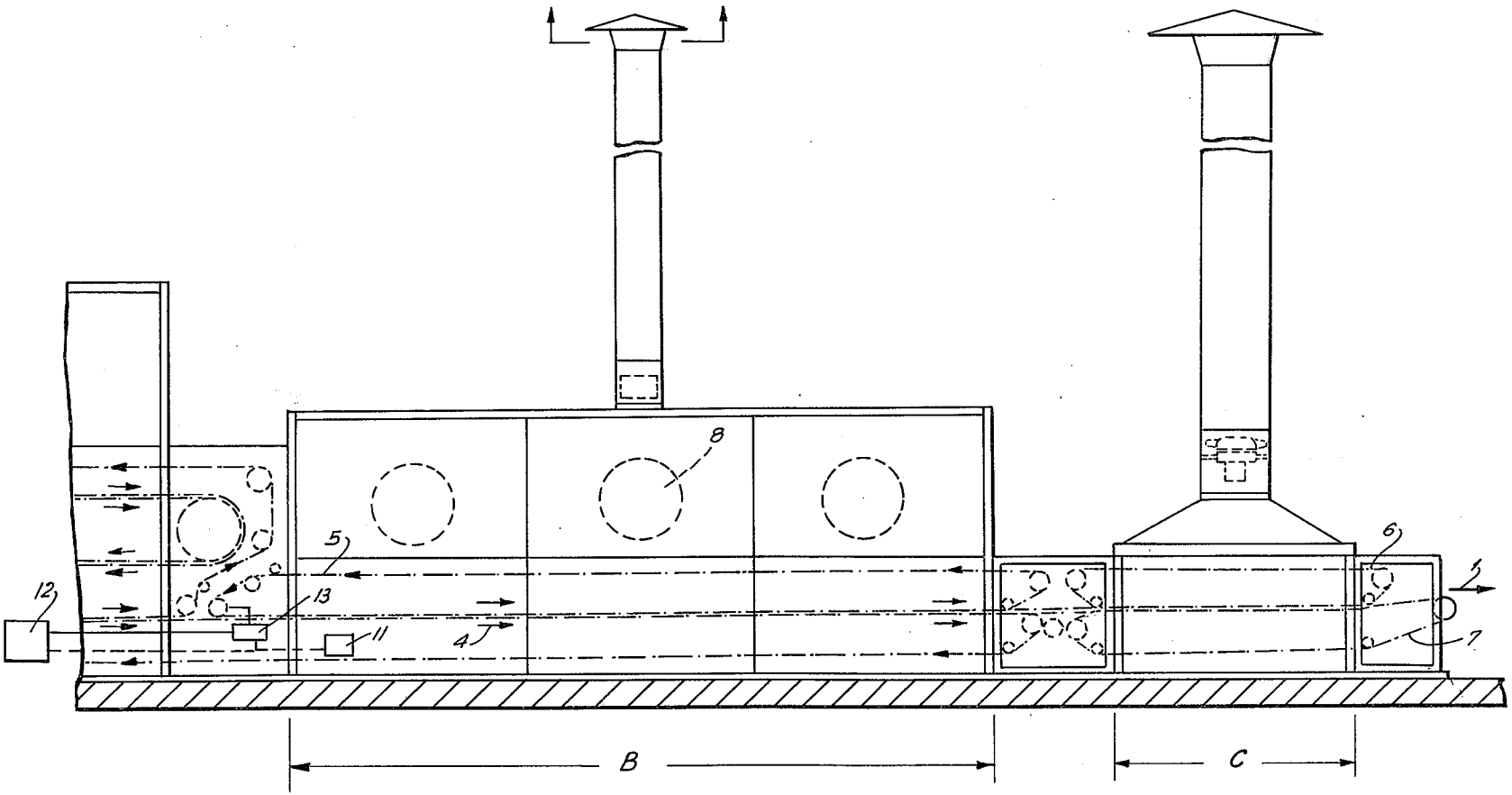
FIG. 2 is a schematic longitudinal section through second stage of the same continuously operating drier having a single band and a cooler.
Figure 3:
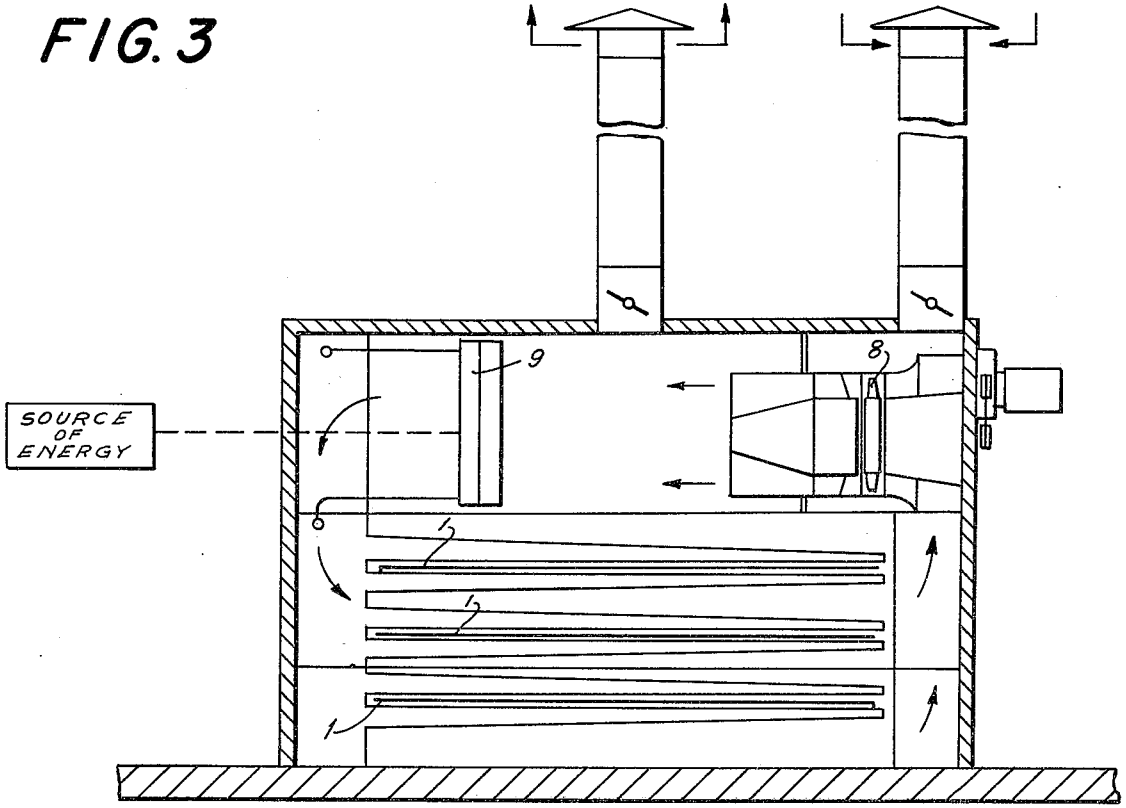
FIG. 3 is a section along line III—III of FIG. 1.

Drier B, shown in FIG. 2 has a single generally horizontally extending belt extending therethrough. This drier B is intended for final drying of the veneer workpiece—since the workpiece surface is particularly susceptible to cracking in this stage due to the demoisturized, brittle nature of the veneer—it is important that pressure on the surface of the still hot workpiece surface be avoided. Consequently, the veneer workpiece is not inverted inside drier B. The inventive concept involves turning the veneer workpiece over only when it is in drier A, which is intended only for preliminary drying. During this preliminary stage, the veneer workpiece still has sufficient excess moisture for flexibility when pressure is applied to its surfaces. Conveyor belt 5 performs the covering function in the drier B—the same function performed by conveyor belt 2 in drier A.

From drier B, the workpiece is directed downstream to a cooler C, also without being turned over. Conveyor belt 6 covers the workpiece as it travels into and through the cooler C.

A stack 10 is provided in each drier as an outlet for air. The first stage drier A may have regulating means connected thereto. As shown in FIG. 1, an automatic monitoring system 11 for monitoring drying temperature and a visual reading instrument 12 connected thereto are installed with the drier A. An automatic speed regulator 13 is operatively connected to the monitoring system and to at least one of the guide rollers for controlling the speed of the roller.

The same regulating means can be installed in the second stage drier B. The corresponding elements are identified by the same reference numbers in FIG. 2.

The heat exchanger 9 may be electrically heated or may be heated by means of heat exchange fluid—as is conventional.

Other elongated workpieces besides veneer may be dried within the inventive drying installation.

It will be understood that each of the elements described above, or two or more together, may also find a useful application in other types of continuously operating drier and a process for continually drying a workpiece differing from the types described above.

While the invention has been illustrated and described as embodied in constructions and steps, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A process for continuously drying a laminated workpiece while maintaining the workpiece free from surface cracks, the process comprising the steps of providing separate multi-belt drier and one-belt drier for treating workpiece having two opposite, longitudinally extending surfaces and containing excess moisture; preliminarily drying the workpiece in said multi-belt drier by turning over the workpiece at least once so as to expose both of its surfaces to heat within said one drier, which turning during the preliminary drying does not lead to cracking of the workpiece since the latter contains excess moisture and thereby its surfaces are not brittle; transporting the preliminarily dried workpiece to said one-piece drier for final drying; finally drying the workpiece in said one-belt drier to a desired moisture level while maintaining the workpiece free from being turned over to thereby avoid cracking the surfaces of the workpiece due to pressure applied to the demoisturized and consequently relatively brittle surfaces thereof, so that because of the preliminary drying of the workpiece with its turning in the multi-belt drier and the final drying of the workpiece without its turning in the one-belt drier a favorable drying efficiency is attained and a crackless dried workpiece is produced; and separately monitoring and regulating the respective drying temperatures and climates in each of said separate multi-belt and one-belt driers.

2. The process of claim 1; and further comprising the steps of transporting the dried workpiece from said one-belt drier to a cooler by conveying the workpiece along the planar path while maintaining the workpiece free from any bending pressure, and cooling the workpiece in said cooler.

3. The process as defined in claim 1, wherein said monitoring and regulating step includes automatically monitoring by an automatic monitoring system for detecting the temperature within the respective drier, and utilizing a visual reading instrument connected to the monitoring system and located outside of the respective drier for indicating variations from a desired drying environment.

4. The process as defined in claim 3, wherein said transporting step includes transporting by conveyor belt means, said monitoring and regulating step further including regulating by automatic speed regulating means connected to the monitoring system and to the conveyor belt means in accordance with the desired drying environment.

5. The process of claim 1, said workpiece being plywood and said steps of transporting being performed by conveying the workpiece along a planar path while maintaining the workpiece free from any bending pressure.

* * * * *